United States Patent [19]

Moore

[11] 4,422,556

[45] Dec. 27, 1983

[54] RECEPTACLES FOR OVERHEAD STORAGE SYSTEMS

[75] Inventor: Junius T. Moore, Charleston, W. Va.

[73] Assignee: The Moore Company, Inc., Charleston, W. Va.

[21] Appl. No.: 230,643

[22] Filed: Feb. 2, 1981

[51] Int. Cl.[3] ..... A47F 7/00

[52] U.S. Cl. ..... 211/119; 211/117; 248/318

[58] Field of Search ..... 211/119, 117, 113, 119.12; 248/318

[56] References Cited

U.S. PATENT DOCUMENTS

| | | | |
|---|---|---|---|
| 2,271,941 | 2/1942 | Kemmitt | 211/119 |
| 2,620,074 | 12/1952 | Moore | 211/119 |
| 3,923,162 | 12/1975 | Hussey | 211/119 |

FOREIGN PATENT DOCUMENTS

| | | | |
|---|---|---|---|
| 472988 | 3/1929 | Fed. Rep. of Germany | 248/318 |

*Primary Examiner*—William H. Schultz
*Assistant Examiner*—Ramon O. Ramirez
*Attorney, Agent, or Firm*—Cushman, Darby & Cushman

[57] ABSTRACT

An improved receptacle for storing articles and hanging clothing, the receptacle being used in a changeroom with a system having means for moving the receptacle between a lowered position of accessibility and an elevated position of inaccessibility. The improved receptacle includes a basket member for storing articles and a bail-like handle member which is of substantially inverted U-shaped configuration and provided with clothes supporting hooks. The handle member is arranged to be attached to the means for elevating or lowering the receptacle. The basket is movable relative to the bail-like handle member and is adapted to be supported by the bail-like handle member so that the clothes hooks carried by the bail-like handle member are free of loads from the basket member.

7 Claims, 7 Drawing Figures

Fig. 1.
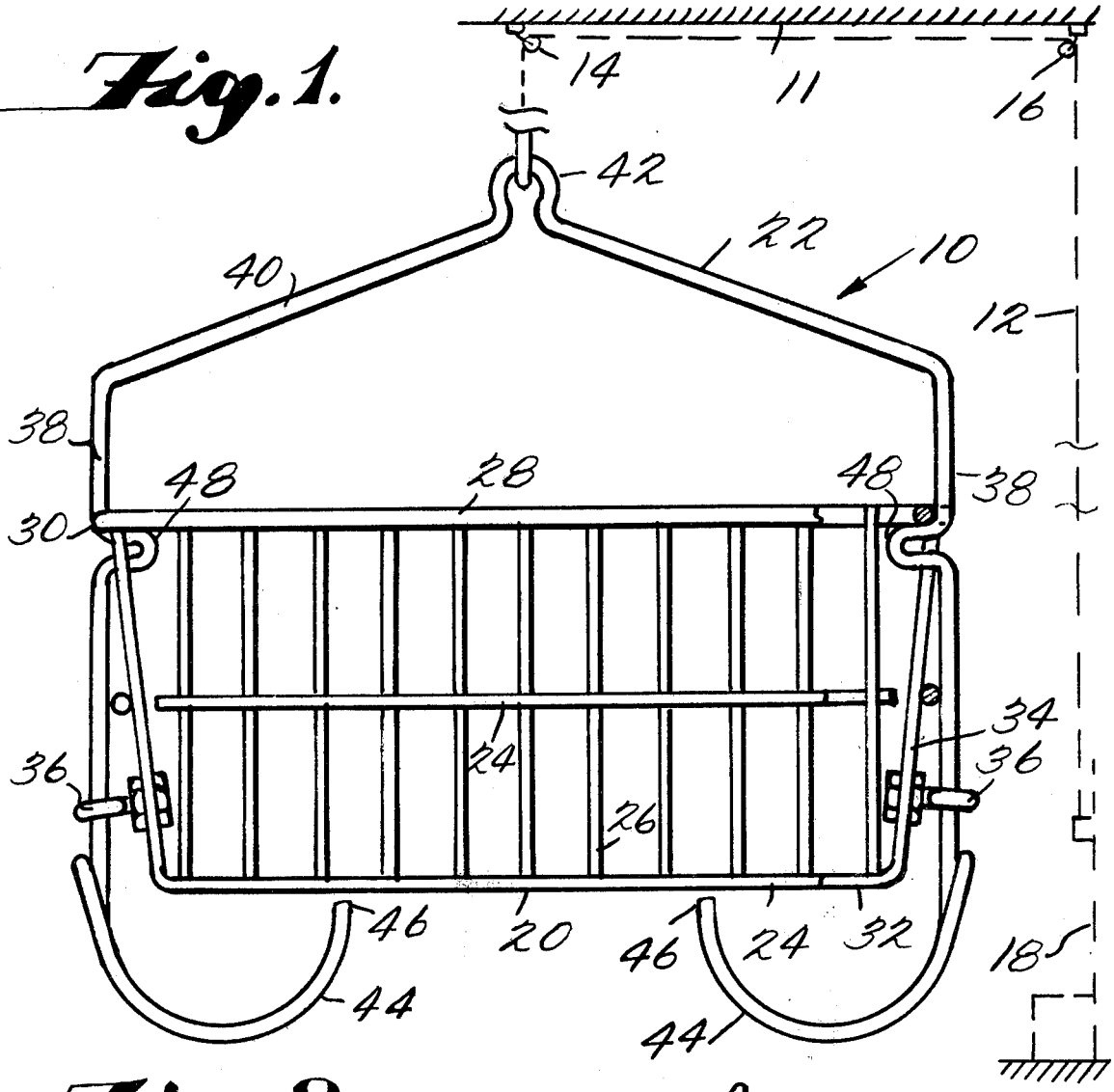
Fig. 2.
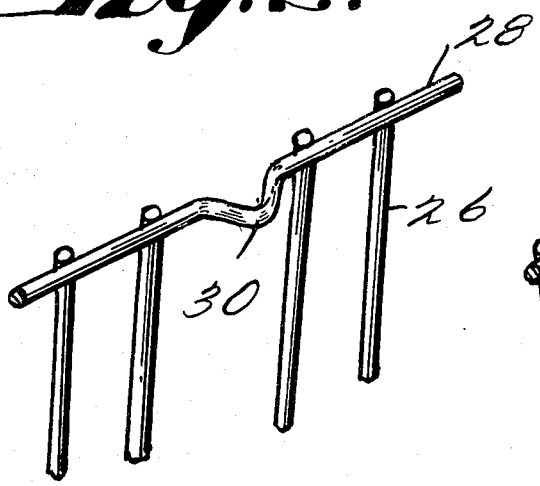
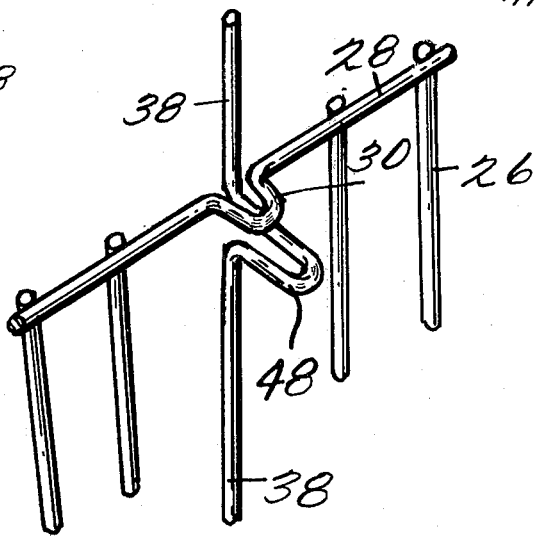
Fig. 3.

RECEPTACLES FOR OVERHEAD STORAGE SYSTEMS

The present invention relates to an improvement of a receptacle for use in a changeroom system of the type having means for moving the receptacle between a lowered position of accessibility and an elevated position of inaccessibility. More specifically, the present invention relates to an improvement in the receptacle comprising a basket member for supporting articles and a bail-like handle member having hooks for hanging clothes, there being means provided for the supporting of the basket member by the bail-like handle member whereby no undue stress is placed on the components of the receptacle, and no loads from the basket member are placed on the hooks of the bail-like handle.

BACKGROUND OF THE INVENTION

In the prior U.S. Pat. No. 2,620,074, issued Dec. 2, 1952, to Junius T. Moore, Jr., and having a common assignee to this application, namely, The Moore Company, Inc., of Charleston, W. Va., there is disclosed a receptacle for use in changerooms wherein the receptacle is capable of being moved between a lowered position of accessibility and an elevated position of inaccessibility. The receptacle disclosed in the aforementioned patent included a basket member for receiving articles such as shoes, helmets, or the like, and a movable bail-like handle member having inturned U-shaped clothes supporting hooks which abutted against the bottom of the basket member to support the same when the basket member was in its lowered position with respect to the handle member. Clothes or the like could be suspended on the hooks when the basket member was raised relative to the handle member and the clothes would be held between the bottom of the basket member and the free ends of the hooks when the basket was lowered relative to the handle member as the receptacle was raised by a link chain.

In U.S. Pat. No. 2,962,253, issued Nov. 29, 1960, to Junius T. Moore, Jr., and also assigned to the common assignee, an improvement was made to the system with regard to providing spring means to absorb shock caused by sudden stopping of the receptacle when lowering, and locking means for locking the receptacle in the elevated position. Subsequently to this and because municipal, state and federal governments have increased safety standards in all phases of operation in equipment used in manufacturing plants, industrial plants, mines and the like, a further improvement to the system was made to provide safety should the elevating means, namely, the link chain be inadvertently dropped by the operator when raising or lowering the receptacle, or should the chain break. This improvement is disclosed in U.S. Pat. No. 4,057,211, issued Nov. 8, 1977, to Junius Thomas Moore, and also assigned to the common assignee. In more detail, U.S. Pat. No. 4,057,211 provided a safety pulley for use in the system, the safety pulley arresting rapid descent of the receptacle due to sudden relaxing of tension in the link chain or breaking of the link chain.

In the systems as disclosed in the aforementioned patents, the receptacle utilized the concept of providing the hooks on the bail-like handle members having free ends which abutted and/or supported the basket member in its lower position with respect to the handle member. However, it has been found that such an arrangement has proved unsatisfactory due to rough and improper handling by personnel, thus resulting in the hooks for the clothes bending when there was an abrupt stopping of the receptacle. This caused the parallel arms of the U-shaped handle member binding in the eye guide bolts and in some instances actually caused the guide bolts to be damaged. The bending of the clothes hooks on the handle member sacrificed their clothes-holding ability, and in some instances resulted in the basket member not hanging level when in use.

BRIEF SUMMARY OF THE INVENTION

In its basic form, the present invention relates to an improved receptacle for storing articles and hanging clothing, the receptacle being used in a changeroom system having means for moving the receptacle between a lowered position of accessibility and an elevated position of inaccessibility. The receptacle is of the type which comprises a basket member for storing articles and a bail-like handle member movable relative to the basket member and having hook members at the lower end thereof for hanging or supporting clothing. The bail-like handle member is of substantially inverted U-shaped configuration having a pair of parallel arms extending downwardly on opposite sides of the basket member, the arms being connected to each other at their upper portion by limbs inclined inwardly and having a bend or a loop arranged to be connected to the means for elevating and lowering the receptacle. Guide means carried by the basket member and receiving the parallel arms guide the basket when moved vertically relative to the handle. The parallel arms are provided at their lower ends with at least one U-shaped clothes supporting hook member which curves inwardly and has a free end extending upwardly beneath and towards the basket member. Basket support means are provided on the parallel arms of the handle member and are spaced upwardly of the U-shaped clothes carrying hooks, the basket support means directly receiving the load from the basket member when the basket member is in its lower position relative to the handle member. The load is transferred directly to the parallel arms without applying a load to the guide bolts or to the free ends of the hook members.

The basket support means engages the basket member on opposite sides thereof at positions spaced upwardly above the eye bolts, and it may include oppositely disposed inwardly bent sections on the parallel arms of the bail-like handle member which engage a peripheral rim about the upper portion of the basket member.

Ancillary to the above, the rim about the periphery of the upper portion of said basket member may be provided with inwardly bent sections arranged to receive the parallel arms and supplement the guiding action of the eye bolts. The inwardly bent sections of the basket support means are arranged to engage the inwardly bent sections on the peripheral rim beneath the same when the basket member is in the lower position relative to the bail-like handle member.

Alternatively, the basket support means may be positioned on said parallel arms beneath the eye bolts but above the clothing hooks, the means being arranged to engage the lower surface or bottom of the basket. In this environment of the invention, the basket support means may include providing the parallel arms with a horizontally extending bent portion on the lower end of each arm, the bent portion defining a step for supporting the basket member. The horizontally extending bent portions of the arm each have an outwardly and downwardly extending portion from its inner end and to which at least one inwardly turned U-shaped clothes supporting hook member is attached.

In each form of the present invention, the basket support means for supporting the basket in the lower position relative to the handle member is so positioned that the clothes supporting hooks have their free ends spaced slightly below the bottom of the basket or at a position where any load from the basket does not pass through the free ends of the hooks into the same. By such an arrangement, no outward forces are placed on the parallel arms of the handle member and, consequently, the components of the receptacle, such as the eye bolts used for guiding the handle, are not damaged and, additionally, the arms do not jam therein, thereby eliminating freezing of the basket member relative to the handle member.

BRIEF DESCRIPTION OF THE DRAWINGS

FIG. 1 of the drawings is a side elevational view of the receptacle including the basket member and handle member, the view also illustrating schematically the changeroom and the system for elevating and lowering the receptacle;

FIG. 2 is an enlarged fragmentary portion of the basket member and illustrating inwardly bent sections on the peripheral rim of the upper portion of the basket;

FIG. 3 is an enlarged fragmentary perspective view similar to FIG. 2 but illustrating the coaction between the inwardly bent section on the handle member and the basket whereby the basket member is supported in its lower position relative to the handle;

DETAILED DESCRIPTION OF THE INVENTION

Figure 4:
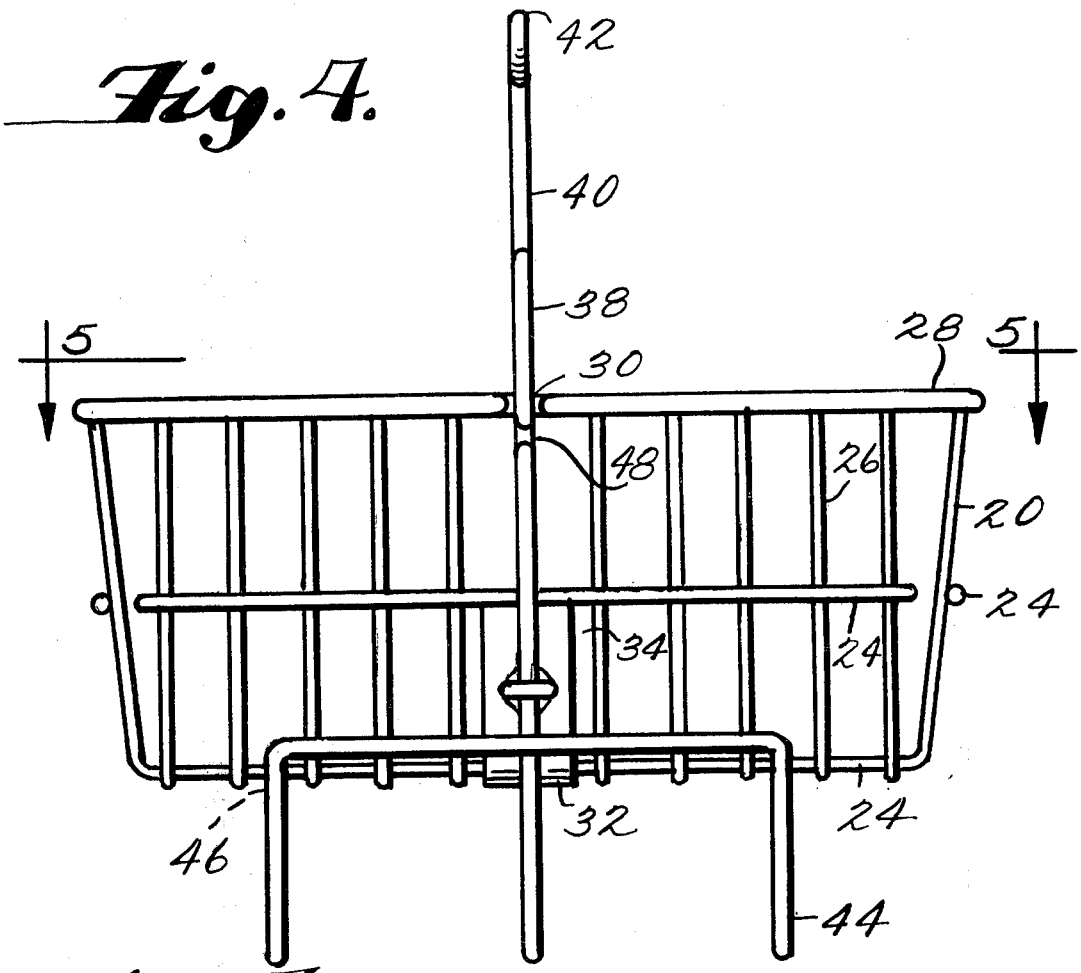
FIG. 4 is a side elevational view of the receptacle of FIG. 1 looking from the left toward the right of the same.
Figure 5:
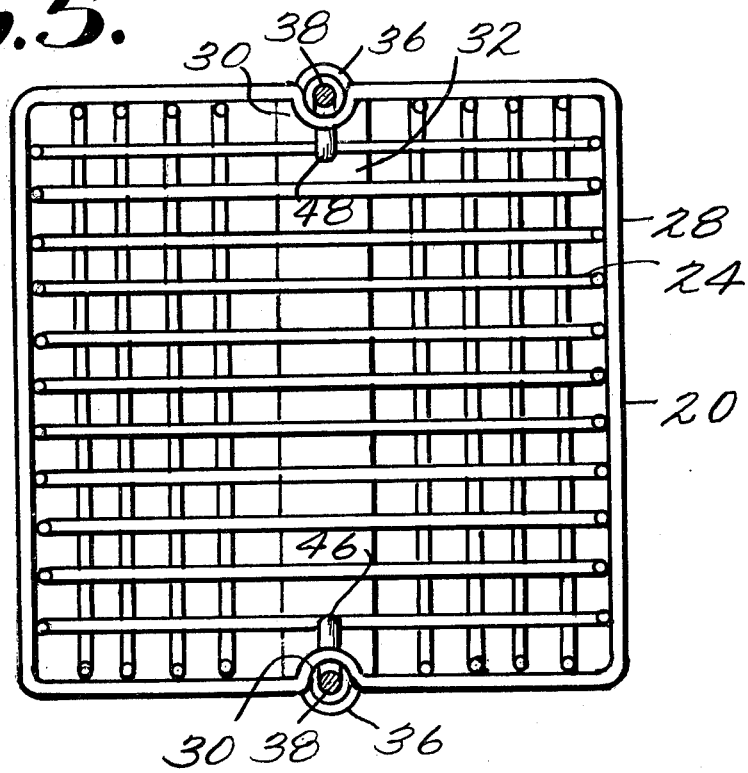
FIG. 5 is a horizontal sectional view of reduced scale and taken on the line 5—5 of FIG. 4.

Referring now to the drawings wherein like characters or reference numerals represent like or similar parts, there is disclosed the improved receptacle for storing articles and hanging clothing of the present invention, the receptacle being identified generally at 10. The receptacle 10 is utilized in a changeroom having an overhead support means 11 to which are attached pulleys 14 and 16. A link chain 12 is secured at one end to the receptacle 10 and extends upwardly over the pulley 14 and downwardly over the pulley 16 and is connected to a bench structure or wall 18. The system for supporting the receptacle 10 as just described may be of the type as disclosed in detail in U.S. Pat. No. 4,057,211 and/or U.S. Pat. No. 2,962,253, and to this extent, the disclosures of these patents are incorporated by reference herein.

The receptacle 10 comprises a basket member 20 for receiving articles such as shoes, helmets and the like, and an inverted U-shaped bail-like handle member 22 having hooks for hanging clothes. The basket member 20 as illustrated may be of the wire mesh type including the usual horizontal and vertical bars or wires 24 and 26 welded to each other at points where they cross one another. The upper peripheral portion of the basket 20 is provided with a peripheral rim 28 welded to the upper ends of the vertical wires 26 as shown in FIG. 2, the rim 28 being provided with oppositely disposed inwardly bent sections 30, the purpose of which will be described later in the specification. A flat metal band 32 extending beneath the basket 20 is provided with upturned ends 34. The band 32 is welded to the horizontal wires forming the bottom of the basket, and its upturned ends 34 serve as anchor plates for eye bolts 36 which provide a guide means for the handle member 22. The eye bolts 36 perform the primary guiding of the basket member 20 when it is moved relative to the handle member 22, and the aforementioned inwardly bent sections provide for a supplementary guiding action.

The handle member 22 includes a pair of parallel arms 38 which extend vertically downwardly from an upper portion 40 having a bend or loop 42 therein arranged to be attached to the end of the link chain 12. In more detail, the parallel arms extend on opposite sides of the basket through the eye bolts 36, and the lower ends of the arms 38 are provided with at least one inwardly turned U-shaped clothes supporting hook member 44. Each hook member 44 is provided with a free end 46 which extends upwardly toward, but terminates short of the bottom of the basket member so that the free end of the hook member never receives a load from the basket member.

Means are provided on the downwardly extending parallel arms 38 for limiting the downward movement of the basket member 20 relative to the handle member 22, this means directly supporting the load of the basket member and its contents and transferring it to the arms 38. As shown in FIGS. 1 through 5, inclusive, the means for supporting the load of the basket member 20 is an inwardly bent section 48 on each arm 38, the inwardly bent section 48 being arranged on the arm 38 above the portion where the arm extends through the eye bolt but below the rim 28. When the basket member is in its lowermost position relative the handle member 22, the inwardly bent sections 48 extend beneath the peripheral rim 28 and engage the inwardly bent sections 30 of the rim 28. By such an arrangement, the load of the basket member is taken directly by the parallel arms 38, and, thus, no load is transferred to the eye bolts 36 or to the free ends 46 of the hook members 44.

While the basket member 28 has been described as a wire mesh type, it will be appreciated that the basket member 20 could be a molded plastic basket member having a peripheral rim about its upper end, the peripheral rim being molded with inwardly bent sections for receiving the arms 38 of the U-shaped bail-like handle 22. Additionally, while the eye bolts 36 have been shown as a bolt having a loop at its end, it will be appreciated by those skilled in the art that the eye bolts could be U-shaped with the legs of the bolt being attached to the upper bent ends 34 of the plate 32 to define the eye.

Figure 6:
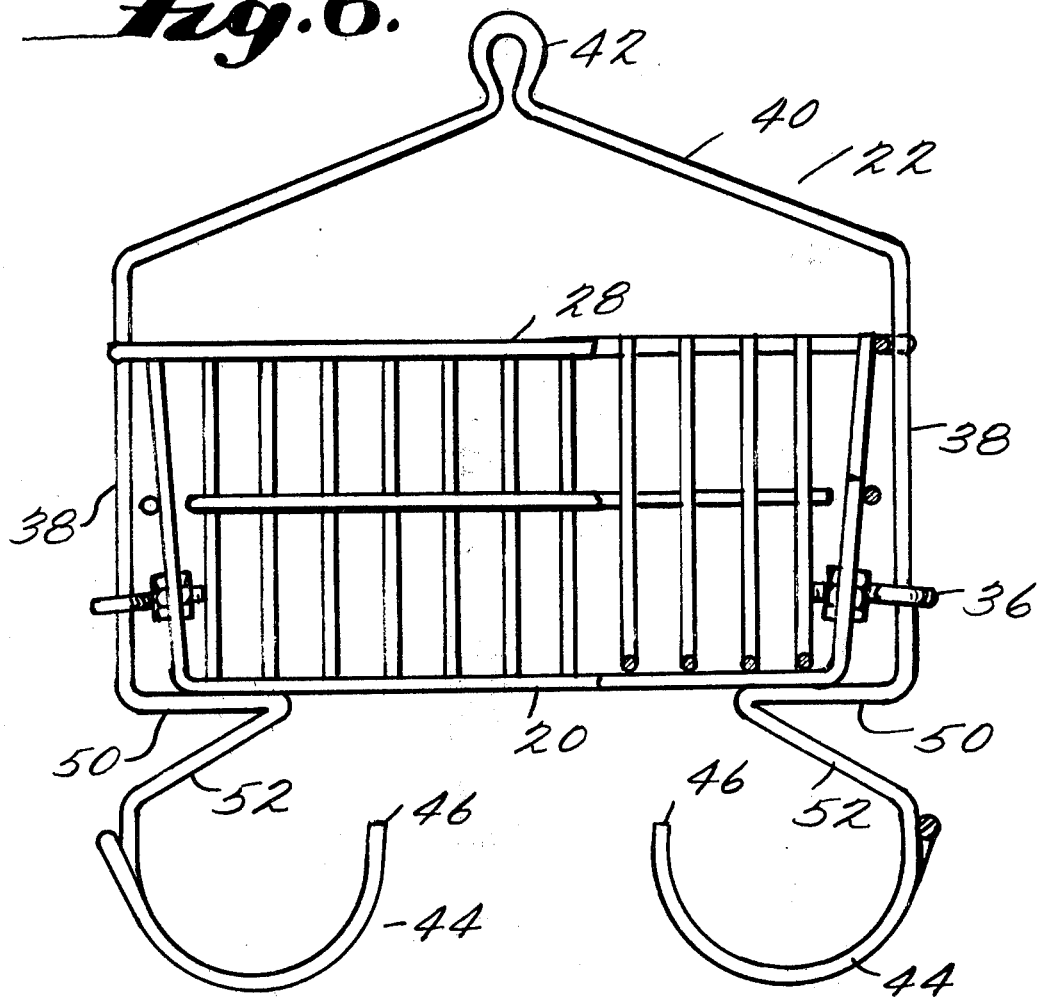
FIG. 6 is a side elevational view similar to FIG. 1 but illustrating a modified receptacle according to the present invention.
Figure 7:
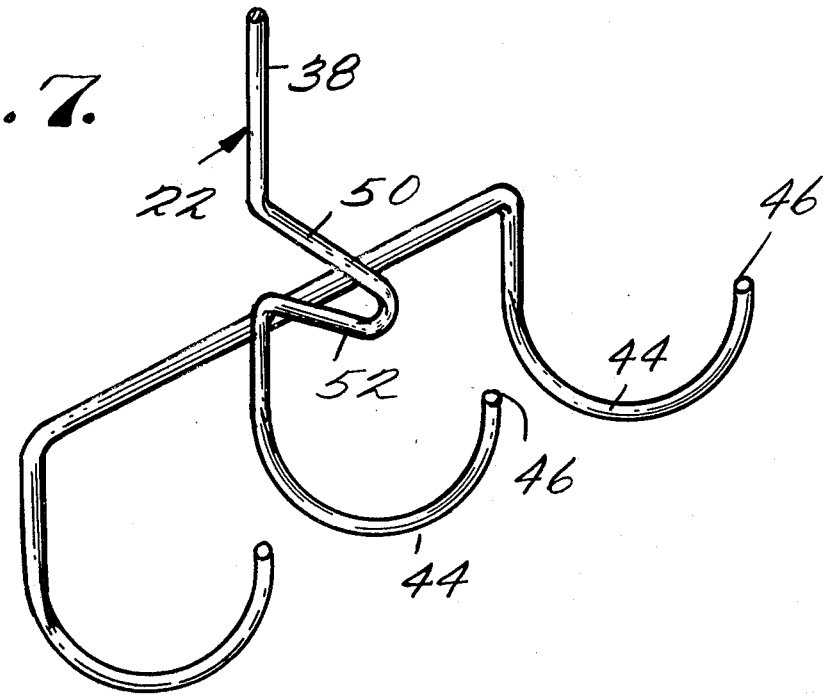
FIG. 7 is a fragmentary perspective view of a portion of the bail-like handle member of FIG. 6, the view also illustrating the clothing supporting hooks carried by the handle member at its lower end.

Referring now to FIGS. 6 and 7, there is disclosed a further modification of the means for supporting the basket member 20 directly by the parallel downwardly extending vertical arms 38 of the inverted U-shaped bail-like handle member 22. In this arrangement of the present invention, the downwardly extending arms 38 are each provided at their lower end with a horizontally and inwardly extending bent portion 50, the bent portion 50 defining a step for engaging the bottom of the basket member 20. The hook members 44 are connected to outwardly and downwardly sloping portions 52 provided on the horizontal portions 50, and, thus, the free ends 46 of the hook members 44 do not engage and receive the load from the basket member when the basket member is in its lowermost position with respect to the handle member 22.

By providing means for supporting the basket member 20 directly from the parallel legs 38 of the handle member 22, the disadvantages incurring from the prior art arrangement where the ends of the hooks supported the basket are obviated. No load is transferred to the eye bolts 36 and, thus, the handle member and basket member may move freely relative one another. Additionally, the hooks receive no load from the basket member and, thus, they maintain their configuration.

The terminology used throughout the specification is for the purpose of description and not limitation as the scope of the invention is defined in the claims.

What is claimed is:

1. An improved receptacle for storing articles and hanging clothing, the receptacle being used in a changeroom system having means for moving the receptacle between a lowered position of accessibility and an elevated position of inaccessibility, said receptable comprising:

a basket member for storing articles;

a bail-like handle member of substantially inverted U-shaped configuration for attachment to said means for moving the receptacle, said bale-like handle member having a pair of parallel arms extending downwardly on opposite sides of said basket member and each of said arms carrying at its lower end at least one inwardly turned U-shaped clothes supporting hook member having a free end extending upwardly beneath and towards said basket member, said basket member being movable relative to said bail-like handle member between a lower position and an upper position;

eye bolts carried by said basket member on opposite sides thereof for receiving said parallel arms therethrough to guide the same when said bail-like handle member is moved relative to said basket member; and basket support means positioned on said parallel arms and spaced upwardly of said U-shaped clothes carrying hooks for directly receiving a load from said basket member and transferring it directly to said parallel arms when said basket member is in the lower position relative to said bail-like handle member whereby the free ends of said hook members extending beneath said basket member are load free.

2. An improved receptacle as claimed in claim 1 wherein said basket member includes a peripheral rim about an upper portion thereof and wherein said basket support means on said parallel arms extends inwardly and engages opposite sides of said rim.

3. An improved receptacle as claimed in claim 2 wherein said basket support means include inwardly bent sections on said parallel arms of said bail-like handle.

4. An improved receptacle as claimed in claim 1 wherein said basket support means engages said basket member on opposite sides thereof at positions spaced upwardly above said eye bolts.

5. An improved receptacle as claimed in claim 1 wherein said basket support means engages said basket member beneath the bottom of said basket on opposite sides thereof at a position spaced below said eye bolts.

6. An improved receptacle as claimed in claim 5 wherein said basket support means includes an inwardly and horizontally extending bent portion on the lower end of each of said parallel legs and defining a step, said inwardly and horizontally extending bent portion having an outwardly and downwardly portion extending from its inner end and to which said at least one inwardly turned U-shaped clothes supporting hook member is attached.

7. An improved receptacle as claimed in claim 1 wherein said basket member includes a peripheral rim about an upper portion thereof, said peripheral rim having oppositely disposed inwardly bent sections to receive said parallel arms and supplement the guiding action of said eye bolts, and wherein said basket support means includes inwardly bent sections on said parallel arms of said bail-like handle for engaging the inwardly bent sections on said rim beneath the same when said basket member is in the lower position relative to said bail-like handle member.

* * * * *